US006311038B1

(12) United States Patent
Schlueter, Jr. et al.

(10) Patent No.: US 6,311,038 B1
(45) **Date of Patent: *Oct. 30, 2001**

(54) CLEANING APPARATUS HAVING MULTIPLE WIPER BLADES

(75) Inventors: Edward L. Schlueter, Jr., Rochester; James F. Smith; Nero R. Lindblad, both of Ontario, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/483,002

(22) Filed: Jan. 18, 2000

(51) Int. Cl.[7] ..... G03G 21/00
(52) U.S. Cl. ..... 399/350
(58) Field of Search ..... 399/350, 351

(56) References Cited

U.S. PATENT DOCUMENTS

| | | | | |
|---|---|---|---|---|
| 3,947,108 | | 3/1976 | Thettu et al. | 355/15 |
| 4,364,660 | | 12/1982 | Oda | 355/15 |
| 4,451,139 | | 5/1984 | Yanagawa et al. | 355/15 |
| 4,984,326 | * | 1/1991 | Horie et al. | 399/351 X |
| 5,081,505 | | 1/1992 | Ziegelmuller et al. | 355/299 |
| 5,208,639 | | 5/1993 | Thayer et al. | 355/299 |
| 5,218,412 | * | 6/1993 | Martin | 399/351 |
| 5,241,351 | | 8/1993 | Owens | 355/299 |
| 5,264,904 | | 11/1993 | Audi et al. | 355/299 |
| 5,394,228 | | 2/1995 | Godlove | 355/299 |
| 5,842,102 | * | 11/1998 | Montfort et al. | 399/351 X |

* cited by examiner

*Primary Examiner*—Fred L Braun
(74) *Attorney, Agent, or Firm*—Linda M. Robb

(57) ABSTRACT

A cleaning apparatus for removing particles from a moving surface includes a movable blade holder having at least one geometrically formed slot. A removable blade matably fits into each geometrically formed slot. Each of the removable blades has at least one cleaning edge, which is in frictional contact with the moving surface during a cleaning operation. An individual blade may be removed from the blade holder by an operator to replace a used cleaning edge with an unused cleaning edge.

20 Claims, 4 Drawing Sheets

FIG. 5
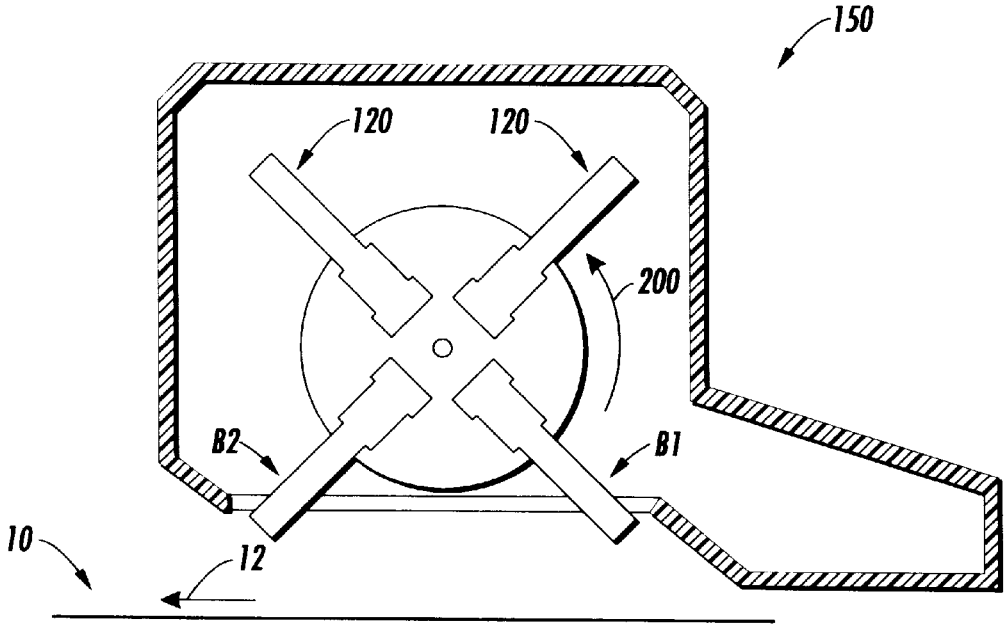
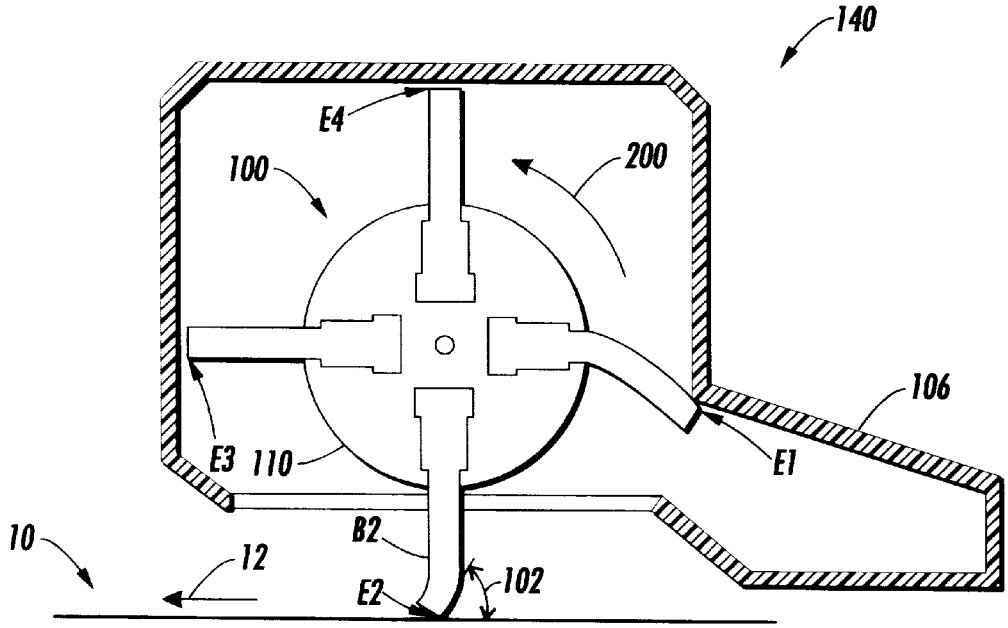
FIG. 6

CLEANING APPARATUS HAVING MULTIPLE WIPER BLADES

BACKGROUND OF THE INVENTION

This invention relates generally to electrophotographic image forming apparatus, and more particularly to cleaning devices for removing residual toner and debris from a charge retentive surface of an image-forming device.

In electrophotographic applications such as xerography, a charge retentive surface of a photoreceptor is electrostatically charged, and exposed to a light pattern of an original image to be reproduced, to selectively discharge the photoreceptive surface in accordance therewith. The resulting pattern of charged and discharged areas on that surface form an electrostatic charge pattern (an electrostatic latent image) conforming to the original image. The latent image is developed by contacting it with a finely divided, electrostatically attractable powder referred to as toner. Toner is held on the image areas by the electrostatic charge on the surface. Thus, a toner image is produced in conformity with a light image of the original bean reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways. Ion projection devices where a charge is imagewise deposited on a charge retentive substrate operate similarly.

Multi-pass and single-pass color electrophotographic printing is substantially identical to the foregoing process of black and white printing. However, rather than forming a single latent image on the photoreceptor, successive latent images corresponding to different colors are recorded thereon. Each single color electrostatic latent image is developed with toner of a color complimentary thereto. This process is repeated in a plurality of cycles for differently colored images and their respective complimentary colored toner. Each single color toner image is transferred to the copy sheet in superimposed registration with the prior toner image. This creates a multilayered toner image on the copy sheet. Thereafter, the multilayered toner image is permanently affixed to the copy sheet as described above to create a color copy. The developer material (toner) may be a liquid material or powder material.

Although a preponderance of the toner forming the image is transferred to the paper during transfer, some toner invariably remains on the charge retentive surface of the photoreceptor, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the surface be cleaned thoroughly therefrom.

The quality of images produced by such equipment depends significantly on the ability to clean the photoconductive surface before it is reused.

Blade cleaning is a highly desirable method for removal of residual toner and debris (hereinafter, collectively referred to as "toner") from a photoreceptor. In a typical application, a relatively thin elastomeric blade member is provided and supported adjacent to and transversely across the photoreceptor surface with a blade edge chiseling (doctor mode) or wiping (wiper mode) toner from the surface. Subsequent to release of toner from the surface, the released toner accumulating adjacent to the blade is transported away from the blade area by a toner transport arrangement, or by gravity.

However, the blades are subject to wear and thus must be replaced. The need for replacement is unpredictable and usually requires a customer service engineer.

Accordingly, to simplify blade replacement and minimize service costs, a need exists for a multiple blade apparatus for cleaning residual toner and debris from the moving, charge retentive surface of an image forming apparatus, such that the blade holder of the multiple cleaning blade indexing apparatus is capable of positioning, loading and aligning each blade within allowable tolerances (as known in the art, tolerances are determined separately for applicable electrophotographic apparatuses). That is, the blade angle to the photoreceptor, blade load against the photoreceptor and alignment of the blade edge to the photoreceptor must be within operational tolerance zones. Further, the blade angle and blade load requirements demand that the blade be locked into position after indexing, and the blade edge alignment requirement dictates that the blade must be free to pivot and align itself to the photoreceptor plane with no interference from the indexing mechanism.

A number of cleaning apparatuses for photoreceptors, which employ a cleaning blade are known and may be briefly summarized as follows:

U.S. Pat. No. 5,394,228 to Godlove discloses a compact multi-blade cleaning system for a photoreceptor device. The blades are formed from a block of thermoplastic material, which has a plurality of parallel cuts extending partially therethrough. The uncut portion of the block forms a connecting member for connecting the plurality of cleaning blades at their securing edges. A mechanism advances the plurality of cleaning blades, one by one, into contact with the photoreceptor device.

U.S. Pat. No. 5,264,904 to Audi et al. discloses an apparatus which cleans a moving imaging surface with a cleaning blade and automatically detects a failure of the cleaning blade. A failure sensing mechanism detects the cleaning blade failure and activates a blade indexing mechanism. The indexing mechanism removes the failed cleaning blade and positions a new cleaning blade in a wiping or doctoring mode frictional contact with the imaging surface for cleaning.

U.S. Pat. No. 5,241,351 to Owens discloses a multi-blade holding apparatus that rotates from one blade to the next. The multi-blade holder holds the cleaning blades in place by using clamping inserts. The clamping inserts also allow for alignment and adjustment of the blades according to thickness. Spring-loaded pins secure the clamping insert to the core of the multi-blade turret holder.

U.S. Pat. No. 5,208,639 to Thayer et al. discloses a multiple turret style blade holder located such that an individual blade is selectively indexed into optimum position for cleaning residual toner and debris from a moving charge retentive surface. The blade holder contains a number of cleaning blades mounted radially from a central core. The indexing device removes the failed cleaning blade and positions a new cleaning blade in frictional contact with the photoreceptor for cleaning.

U.S. Pat. No. 5,081,505 to Ziegelmuller et al. discloses a rotatable wiper blade roller for cleaning residual toner particles from an image bearing surface and includes a plurality of indexable wiper blades. The blades engage the image bearing surface at an angle of 60° to 85° defined in the direction of particle removal by the cleaning edge of each such blade and image-bearing surface. The blades are cleaned secondarily by an intermittently rotatable brush that is completely out of contact with the image-bearing surface.

U.S. Pat. No. 4,451,139 to Yanagawa et al. discloses a cleaning apparatus for a photoreceptor, which includes an elastic polyurethane cleaning blade located downstream of a rotating brush with respect to the rotation direction of the photoreceptor.

U.S. Pat. No. 4,364,660 to Oda discloses a photoreceptor cleaning system having a cleaning blade, which removes toner from a photoreceptor. A brush located upstream of the cleaning blade acts as a toner recovery mechanism to recover toner removed from the photoreceptor by the cleaning blade.

U.S. Pat. No. 3,947,108 to Thettu et al. discloses a photoreceptor cleaning system wherein a blade acts as a primary cleaning member. A brush located downstream from the blade removes the residual film from the photoreceptor not removed by the blade.

SUMMARY OF THE INVENTION

Briefly stated, and in accordance with one aspect of the present invention, there is provided an apparatus for removing particles from a moving surface. The apparatus includes a movable blade holder having at least one recess into which fits a removable cleaning blade. Each of the blades has at least one cleaning edge, which is in frictional contact with the moving surface during a cleaning operation. An individual blade may be removed to replace a used cleaning edge with an unused cleaning edge.

In accordance with another aspect of the present invention, there is provided a printing machine of the type having a photoconductive member in the form of an image bearing belt and apparatus for removing particles from a surface within that machine. The apparatus includes a blade holder having at least one recess formed within the blade holder and into which fits a removable cleaning blade. Each cleaning blade includes at least one cleaning edge, which is in frictional contact with the moving surface during a cleaning operation. An individual blade may be removed to replace a used cleaning edge with an unused cleaning edge.

BRIEF DESCRIPTION OF THE DRAWINGS

The foregoing and other features of the instant invention will be apparent and easily understood from a further reading of the specification, claims and by reference to the accompanying drawings in which:

FIG. 5 is a cross-sectional view of an embodiment of the present invention indexed to a second position.

FIG. 6 is a cross-sectional view of the cleaning apparatus of the present invention indexed to place a second blade in the first position.

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims

DETAILED DESCRIPTION OF THE INVENTION

Figure 1:
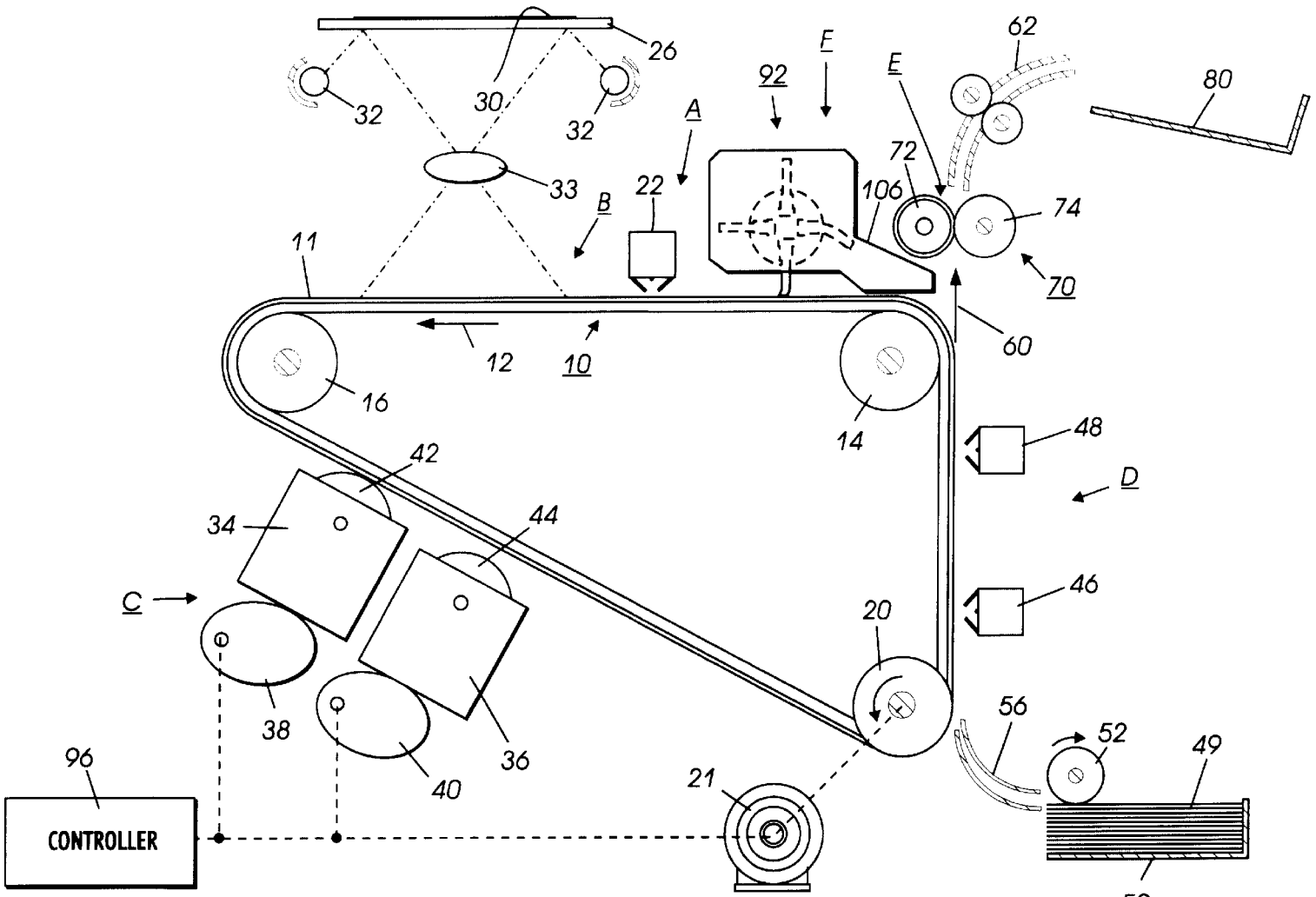
FIG. 1 is a schematic illustration of a printing apparatus incorporating the inventive features of the present invention.

For a general understanding of an electrophotographic printer or copier, in which the present invention may be incorporated, reference is made to FIG. 1, which depicts schematically the various components thereof. Hereinafter, like reference numerals have been used through out to identify identical elements. Although the blade cleaner for spots and toner of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At exposure station B, an original document 30 is positioned face down on a transparent platen 26 for illumination with flash lamps 32. Light rays reflected from the original document are reflected through a lens 33 and projected onto the charged portion of the photoreceptor belt 10 to selectively dissipate the charge thereon. This records an electrostatic latent image, which corresponds to the informational area contained within the original document, onto the belt. Alternatively, a laser may be provided to image-wise discharge the photoreceptor in accordance with stored electronic information.

Thereafter, the belt 10 advances the electrostatic latent image to developing station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the image side of photoreceptor belt 10 after each copy is made, may be removed at cleaning station F. The cleaning apparatus of the present invention is represented by the reference numeral 92, which will be described in greater detail in FIGS. 2–6. At cleaning station 92 residual toner particles are removed and may also be stored for disposal.

A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic printing machine, which exemplifies one type of apparatus employing the present invention therein. Reference is now made to FIGS. 2–5, where the showings are for the purpose of illustrating preferred embodiments of the present invention and not for limiting the same.

Figure 2:
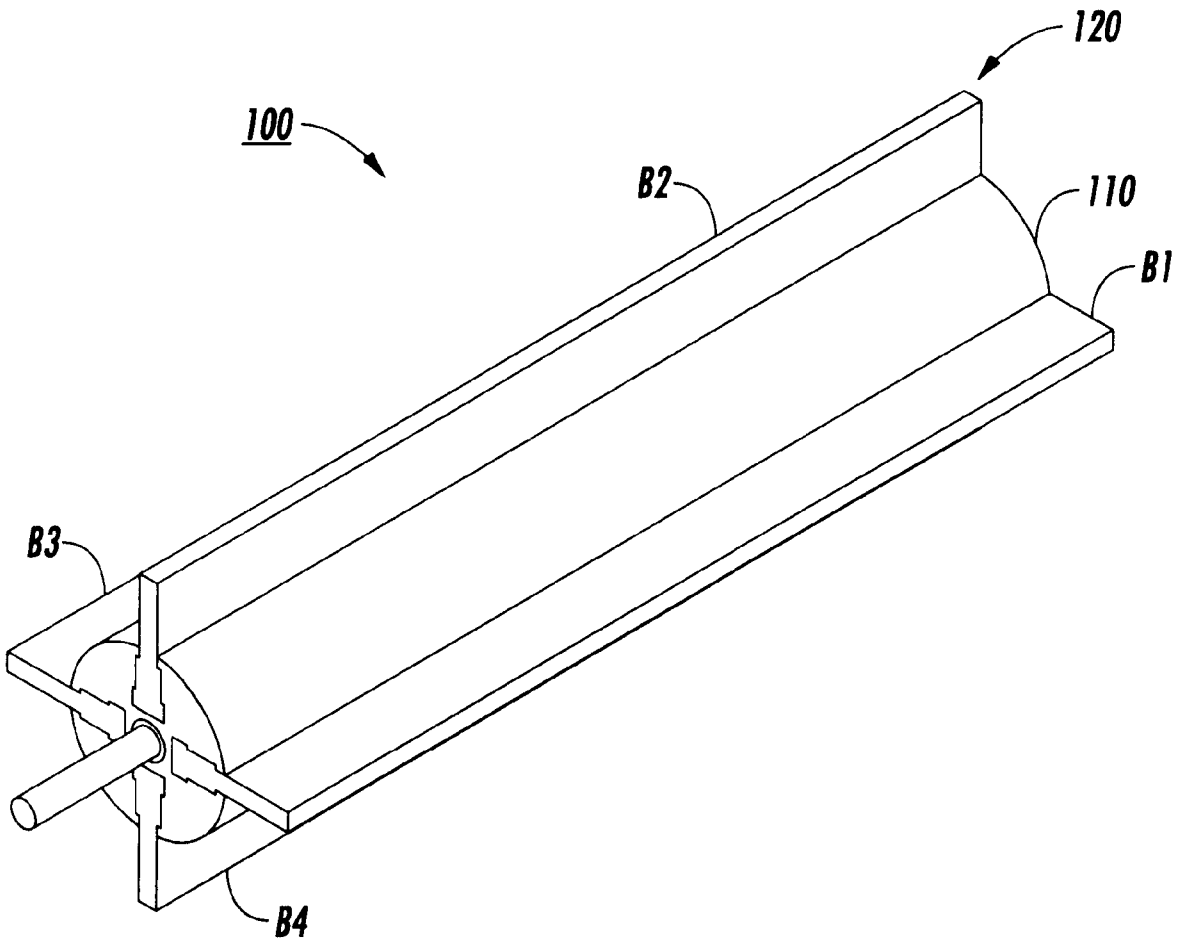
FIG 2 is an elevational view of an embodiment of the present invention.

Referring now to FIG. 2, the cleaning apparatus 100 of the present invention includes a plurality of cleaning blades designated generally as 120. The plurality of blades 120 includes at least a first blade B1 and a second blade B2. Additional blades such as blades B3 and B4 may also be added. Although only four blades are shown, any number of blades including the first and second blades B1, B2 may be used in the structure of the present invention.

Figure 3:
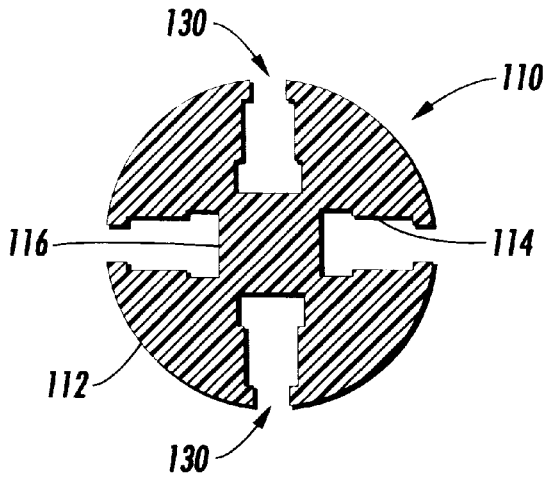
FIG. 3 is a cross-sectional view of an embodiment of the blade holder of the present invention in a first blade position.

The cleaning apparatus 100 also includes housing 106 (shown in outline in FIG. 1), which substantially surrounds the cleaning blades 120. Within the housing 106, the blades B1 to B4 are mounted in a rotatable blade holder 110, which holds and supports the cleaning blades 120, which are mounted radially in the blade holder. As can be seen in FIG. 3, blade holder 110 in cross section includes central portion 116 from which extrusions 112 extend radially outward. Extrusions 112 are spaced apart from each other. The facing sides 114 of each two adjacent extrusions 112 form geometrically shaped slots 130, which correspond to the profiles of cleaning blades 120. As may be appreciated by one skilled in the art, the slot configuration illustrated in FIG. 3 could assume the form of numerous geometries. Each cleaning blade fits slidably and matably into one of the slots 130, which conform to the size and geometry of all enclosed surfaces of each mating blade 120, thus securing blades 120 into operative position. Typically the blade holder is formed from a hard plastic material.

Figure 4:
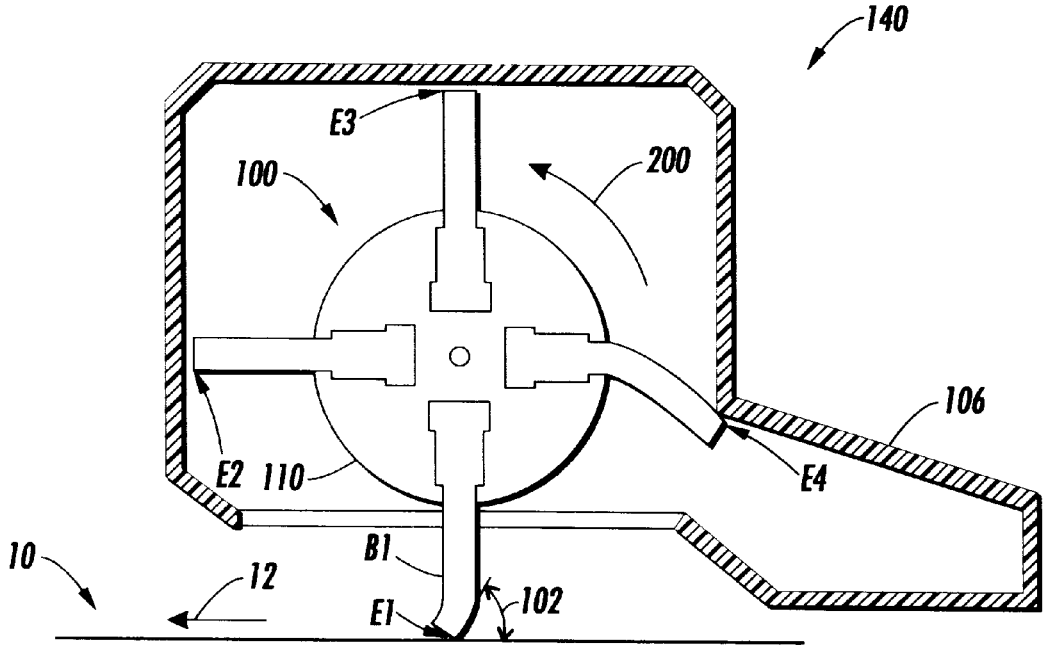
FIG. 4 is a cross-sectional view of an embodiment of the present invention.

Referring now to FIG. 4 the relatively thick urethane blade B1 having a hardness ranging from approximately 50–85 Shore A is positioned adjacent to and transversely across the photoreceptor belt 10 in a wiping mode at the optimal level for shearing release of agglomerate particles and toner without the occurrence of the cleaning blade exhibiting stick-slip motion. Alternatively, the blade B1 may be a relatively thick polyurethane having a hardness ranging from approximately 90–120 Shore A. Each blade B1 to B4 has a rectangular cleaning tip that includes two sharp cleaning edges. The square cleaning edges E1, E2, E3 and E4 are the lead cleaning edges, and the opposite square cleaning edges to E1, E2, E3, and E4 are the trailing edges. These cleaning edges may be used when the leading edges become defective. This can be accomplished by simply removing the defective cleaning blade from the holder, and sliding the blade back into the holder 110 with the trail edge in the lead edge position. All the cleaning edges can be rotated into forming a sealing and cleaning contact or engagement with the surface 10 being cleaned.

In the present invention, the movable plurality of blades 120 has a first stationary position 140 into which each of the blades B1 to B4 can be moved for wipingly engaging, sealing against, and cleaning the image-bearing surface 10. For example, in FIG. 4, the first blade B1 is shown in this first position 140. The apparatus 100 is mounted such that the cleaning edge of a blade in this first position, for example the edge E1 of the first blade B1, will make a wiping and cleaning contact with the surface 10 at a desirable and predetermined working angle 102. The working angle 102 as shown is the acute angle between the deflected cleaning tip and the surface 10. With the surface 10 being moved, for example in the direction of the arrow 12, the cleaning edge of the blade in the first position, for example the edge E1, will wipe and remove residual toner and other particles from such surface. The material removed from the cleaning surface can then be cleaned from the blades by any of numerous methods. For example, the excess toner and debris on the blades can be flicked off the cleaning edge with a flicker bar, air can be used to vacuum the edges clean, or the edges can be wiped or brushed clean. The particles are collected in housing 106. In the present invention, each blade B1 to B4 is movable into and out of the first position 140, but each such blade is held in a stationary condition while performing such cleaning in such first position.

The cleaning apparatus of the present invention further consists of means for periodically indexing and thus moving the plurality of blades 120. Each indexing movement is such as to move the cleaning edge of a blade, for example the edge E1 of the first blade B1, from the stationary first position 140, where it is in cleaning contact with the surface 10, into a stationary second position 150, shown in FIG. 5, in which all of blades 120 are remote from the surface 10. The indexing movement then moves a new blade B2 with edge E2 into the first and cleaning contact or engagement position 140 with the surface 10, as shown in FIG. 6. Thus, in the present invention, such indexing can continue around and around with each blade B1 to B4 being cyclically and periodically moved, respectively, into and out of the first and second stationary positions.

During such cyclical movement, as each blade B1 to B4 is indexed into the stationary first position 140, the respective cleaning edge E1, E2, E3 or E4 thereof will first lightly contact, and then gradually press against the surface 10 due to a compressive force being applied to the blade in such position. Such behavior of the blade edge is also due to the springy nature of the urethane material of each blade. Such gradual pressing of the cleaning edge E1 against the surface 10 causes the edge to deform and thereby to conform more precisely to the surface 10. Because the blade in the first position is held stationary in such position for as long a period as is desired, there is advantageously a longer period of time and greater opportunity for the cleaning edge, for example E1, to conform more precisely to the surface 10 than would be the case with a continuously rotating cleaning blade. Such precise conformity of the cleaning edge with the surface being cleaned results in an effective seal of the cleaning edge against the surface 10. A more precise seal, as such, will prevent substantial or significant quantities of fibers and particles from being trapped between such cleaning edge and the surface 10.

Accordingly, in the present invention, indexing one of the cleaning blades B1 to B4 into the first stationary position, at a cleaning angle 102 between 70°–80° and with a compressive force between 20–50 gm/cm onto the particles, will desirably result in an effective seal of the cleaning edge thereof against the surface 10, and in good cleaning. The trapping of residual fibers and particles between such cleaning edge, for example E1, and the surface 10 should be substantially reduced.

However, some fibers and particles, particularly very small and very fine fibers, which have little to no mass, still are trapped by the cleaning edge against the surface 10. If allowed to remain so trapped, even these small and fine particles and fibers will eventually begin to undesirably scratch the surface 10, as well as undesirably push the cleaning edge out of a desired sealing contact with the surface 10, thereby resulting in poor cleaning.

To prevent such undesirable results, the present invention periodically indexes such cleaning edge from the first cleaning position into a remote, second stationary position illustrated in FIG. 5. The present invention then indexes the blade holder again to bring the second blade B2 into wiping contact with the surface 10, as shown in FIG. 6. Such indexing of each cleaning blade ensures effective cleaning of the surface 10, as well as a relatively much longer life for the cleaning apparatus. Blades whose edges are worn can be slidably removed from the blade holder, directionally reversed, and slidably replaced into the blade holder to expose the unused edges of the blades for cleaning purposes. Although the cleaning apparatus of the present invention has been described in conjunction with cleaning the image-bearing surface of a photoreceptor belt, it is readily apparent to one knowledgeable in the art that it may also be employed to desirable effect in cleaning the back side of a photoreceptor belt, a drive roller supporting a photoreceptor belt, or an intermediate belt in an electrophotographic printing machine.

An important advantage of the four-blade cleaner is that it can be used in a multi-pass color printer. This type of a printing scheme requires that the cleaning element (blade, brush, foam, etc.) must be removed from the imaging surface 10 until all the color development cycles are completed. After the complete color image has been developed it is transferred to paper, and then the cleaning element is engaged to clean the residual toner on the surface 10. This process of engaging and disengaging the cleaning element can be accomplished by a simple rotation of the blade holder and can be effectively done with up to four blades mounted on the rotating blade holder. For example, FIG. 5 shows the four cleaning blades disengaged from the surface to allow the images to pass under the cleaner undisturbed. And FIG. 6 illustrates the cleaning blades rotated back into the cleaning position. Thus the four blade cleaner works effectively in a multi-pass printer, and has better reliability than a single blade cleaner. By utilizing four cleaning blades (eight cleaning edges), the cleaner becomes a "life of the machine" part. Also, the cost of the blade is reduced by a factor of two because both cleaning edges of the square cut are utilized. Over all cleaner service costs are significantly reduced because there are four blades available for cleaning instead of one. The ability to use both cleaning edges and slide the blades in and out of the holder is another main advantage of the blade holder shown in FIG. 3.

The single-pass color printer has higher process speed and longer machine life than a multi-pass printer. The typical cleaner used in a single-pass printer is a dual electrostatic brush cleaner with either air or electrostatic detoning to remove the toner from the brushes. These cleaners are used mainly because they are more reliable than a blade cleaner, but the cleaner cost can range from $300 to $1200. Because the four-blade cleaner has reliability that now approaches the reliability of an electrostatic brush cleaner and is much less expensive, it becomes a viable choice to use in a single-pass printer. There is yet another important advantage. Electrostatic brush cleaners do not have the capability of removing films or spots on the imaging surface. Such films and spots are caused by the additives used in toners and debris from paper products, such as kaolin, ream wrapper glue. The most effective way to control the level of film is to use a blade to continuously remove the filming additives and any spot forming debris from the outset before it can build to levels where copy quality is adversely affected and the imaging surface needs to be replaced.

It is therefore apparent that there has been provided, in accordance with the present invention, a cleaning apparatus for removing spots and toner from a surface that fully satisfies the aims and advantages set forth hereinabove. While this invention has been described in conjunction with specific embodiments thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed:

1. A cleaning apparatus for removing particles from a moving surface, comprising:

a plurality of blades having a size and geometry for removably and matably securing said blades, each one of said blades including at least one cleaning edge in frictional contact with the moving surface for removing particles from the surface during a cleaning operation, said blades being operator removable to replace a used cleaning edge with an unused cleaning edge; and a rotatable, single-piece self-clamping blade holder having a central portion and a plurality of extrusions extending radially outward from said central portion, said extrusions being spaced from one another, wherein the facing sides of each adjacent two such extrusions form a geometrically shaped slot, wherein each of said slots conforms to the size and geometry of all enclosed surfaces of one of said mating blades when said blades are removably mounted in said blade holder, so as to securely lock said mating blades into operative position.

2. The apparatus according to claim 1, wherein said cleaning blades extend radially outward from the central axis of said blade holder.

3. The apparatus according to claim 1, wherein said blade holder comprises a material which causes said blade holder to be substantially hard.

4. The apparatus according to claim 1, wherein the cleaning edge contacting the surface forms a cleaning angle with the surface, wherein said cleaning angle is an included angle ranging from about 70° to about 80°.

5. The apparatus according to claim 1, further comprising indexing means for indexing said blade holder to rotate and position one of said cleaning blades into frictional contact with the surface and to space said first mentioned cleaning blade remotely from the surface.

6. The apparatus according to claim 5, wherein said indexing means rotates said blade holder to a stationary first position in which the cleaning edge of said blade engages and cleans the surface, and to a stationary second position spaced from the surface.

7. The apparatus according to claim 1, wherein said blade applies a normal force ranging from about 20 to about 50 gm/cm on the particles being removed from the surface.

8. The apparatus according to claim 1, wherein said blade comprises a second cleaning edge spaced from said first mentioned cleaning edge.

9. The apparatus according to claim 1, wherein said blade is mounted slidably in the geometrically formed slot of said blade holder, said blade being removed from the geometrically formed slot and reversed, and reinserted into the geometrically formed slot to replace the used cleaning edge with the unused cleaning edge.

10. The apparatus according to claim 1, wherein said blade holder comprises a molded portion.

11. A printing machine of the type having a photoconductive member in the form of an endless dielectric belt entrained about a supporting device including a cleaning apparatus, wherein the improvement comprises:

a plurality of blades having a size and geometry for removably and matably securing said blades, each one of said blades including at least one cleaning edge in frictional contact with a moving surface within said printing_machine for removing particles from said surface during a cleaning operation, said blades being operator removable to replace a used cleaning edge with an unused cleaning edge; and a rotatable, single-piece self-clamping blade holder having a central portion and a plurality of extrusions extending radially outward from said central portion, said extrusions being spaced from one another, wherein the facing sides of each adjacent two such extrusions form a geometrically shaped slot, wherein each of said slots conforms to the size and geometry of all enclosed surfaces of one of said mating blades when said blades are removably mounted in said blade holder, so as to securely lock said mating blades into operative position.

12. The apparatus according to claim 11, wherein said cleaning blades extend radially outward from the central axis of said blade holder.

13. The apparatus according to claim 11, wherein said blade holder comprises a material which causes said blade holder to be substanstially hard.

14. The apparatus according to claim 11, wherein the cleaning edge contacting the surface forms a cleaning angle with the surface, wherein said cleaning angle is an included angle ranging from about 70° to about 80°.

15. The apparatus according to claim 11, wherein each of said cleaning blades has a stationary first position for engaging and cleaning the surface, and a stationary second position spaced from such surface.

16. The apparatus according to claim 11, further comprising indexing means for indexing said blade holder to rotate and position one of said cleaning blades into frictional contact with the surface and to space said first mentioned cleaning blade remotely from the surface.

17. The apparatus according to claim 16, wherein said indexing means rotates said blade holder to a stationary first position in which the cleaning edge of said blade engages and cleans the surface, and to a stationary second position spaced from the surface.

18. The apparatus according to claim 11, wherein said blade comprises a second cleaning edge spaced from said first mentioned cleaning edge.

19. The apparatus according to claim 11, wherein said blade is mounted slidably in the geometrically formed slot of said blade holder, said blade being removed from the geometrically formed slot and reversed, and reinserted into the geometrically formed slot to replace the used cleaning edge with the unused cleaning edge.

20. The apparatus according to claim 11, wherein said blade holder comprises a molded portion.

* * * * *